US005120249A

United States Patent [19]

Fonda

[11] Patent Number: 5,120,249

[45] Date of Patent: Jun. 9, 1992

[54] COMBINATION CATAMARAN BOAT AND CROSS WATER SKI SYSTEM

[76] Inventor: Jacob H. Fonda, 4085 Rte. 247, Canandaigua, N.Y. 14424

[21] Appl. No.: 741,081

[22] Filed: Aug. 6, 1991

[51] Int. Cl.[5] ..... B63B 35/83; B63B 1/10

[52] U.S. Cl. ..... 441/77; 114/39.1; 114/61; 114/163

[58] Field of Search ..... 441/76, 77, 73; 114/61, 114/39.1, 163, 162

[56] References Cited

U.S. PATENT DOCUMENTS

| | | | |
|---|---|---|---|
| 3,027,576 | 4/1962 | Fines | 441/76 |
| 4,037,280 | 7/1977 | Klepsch | 441/76 |
| 4,527,984 | 7/1985 | Gilbert | 441/76 |
| 4,534,305 | 8/1985 | Lecomte | 441/73 |

FOREIGN PATENT DOCUMENTS

| | | | |
|---|---|---|---|
| 0353901 | 2/1990 | European Pat. Off. | 114/39.1 |

*Primary Examiner*—Sherman D. Basinger
*Attorney, Agent, or Firm*—Robert J. Bird

[57] ABSTRACT

A combination catamaran boat and cross water ski system includes left and right hulls, a bridging deck, and a steering system. Each hull includes a rudder in its keel portion and a rudder plate on its top, connected by a rudder shaft for pivotal movement. A footpiece on each rudder plate is for a skier's feet. The steering system includes a tiller above the deck connected to a tiller lever system below the deck, and a rudder crossbar connecting the tiller lever system to the rudder plates on the hulls. The left and right hulls are separable from the deck and steering system, and convertible to use as right and left cross water skis respectively. Ski poles each include a handle with an upper portion and laterally offset lower portion, and a pontoon.

6 Claims, 4 Drawing Sheets

Fig. 6
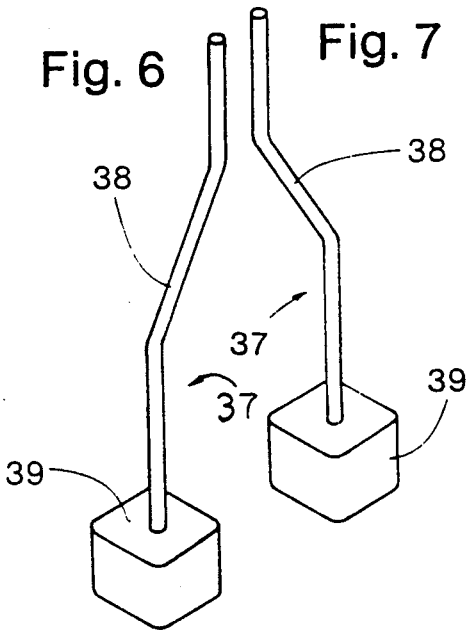
Fig. 7
Fig. 5
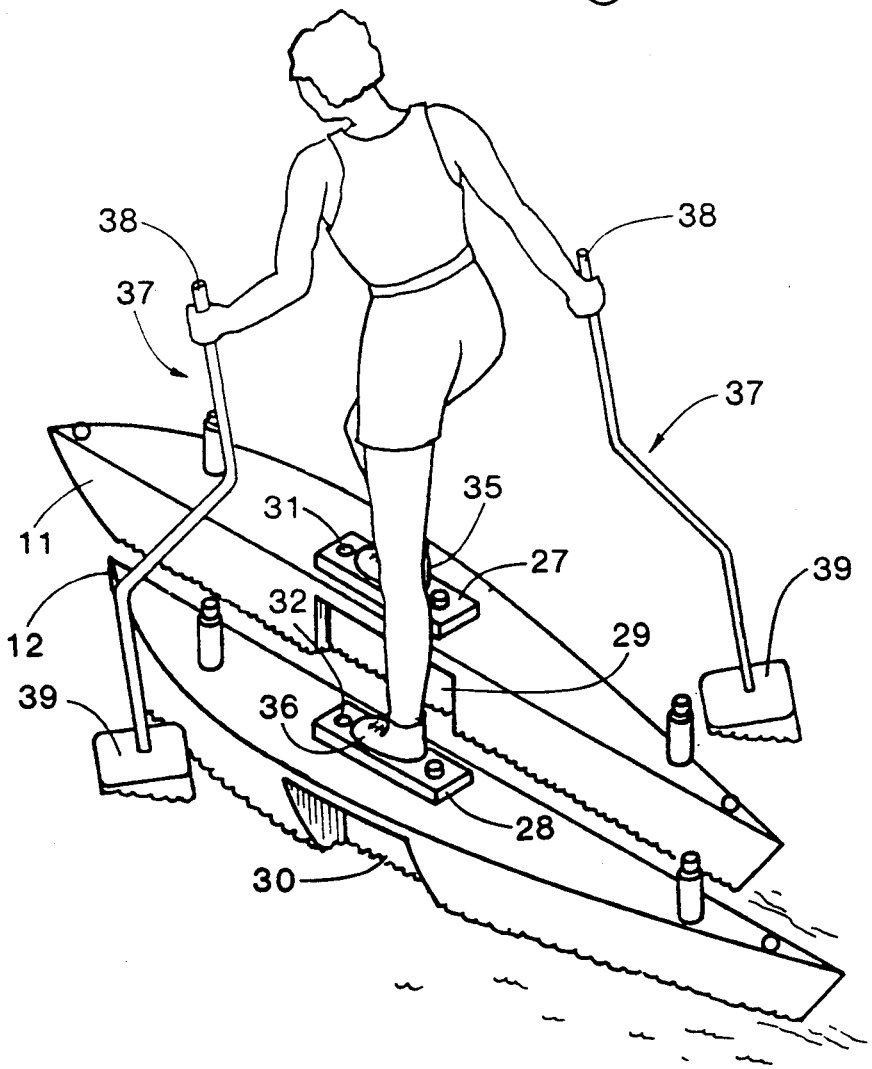

COMBINATION CATAMARAN BOAT AND CROSS WATER SKI SYSTEM

BACKGROUND INFORMATION

This invention is a modification of the catamaran form of sailboat. A catamaran is a sailboat having two hulls spaced apart and connected by a bridging deck. Catamarans are commonly collapsible for transportation and storage, the two hulls being separable from each other and from the deck, mast, and so on.

Cross country skiing has grown in popularity in recent years as an alternative to downhill skiing because it is less expensive, more convenient, and it is good exercize. An analogous form of skiing and exercize can be done on water. I will call it "cross water skiing".

The collapsible catamaran in general, and cross country skiing in general, are the background of the present invention and the only relevant prior art that I know of.

SUMMARY OF THE INVENTION

The present invention is a combination catamaran sailboat and cross water ski system. It includes left and right hulls, a bridging deck, and a steering system. Each hull includes an off center keel portion, a rudder in the keel portion, and a rudder plate on the top of the hull. The rudder and rudder plate are connected by a rudder shaft for pivotal movement on the hull. A footpiece on each rudder plate is for a skier's feet. The steering system includes a tiller mounted above the deck, a tiller lever system connected to it below the deck, and a rudder crossbar pivotally connected at its center to the tiller lever system and at its ends to the rudder plates on the hulls. The left and right hulls are separable from the deck and steering system and convertible to use as right and left cross water skis respectively. Ski poles each include a handle with an upper portion and a laterally offset lower portion, and a buoyant pontoon on the lower end.

DRAWING

FIG. 5 shows the sailboat hulls in use as cross water skis.

FIGS. 6 and 7 are side and front views of a cross water ski pole.

DESCRIPTION

Figure 1:
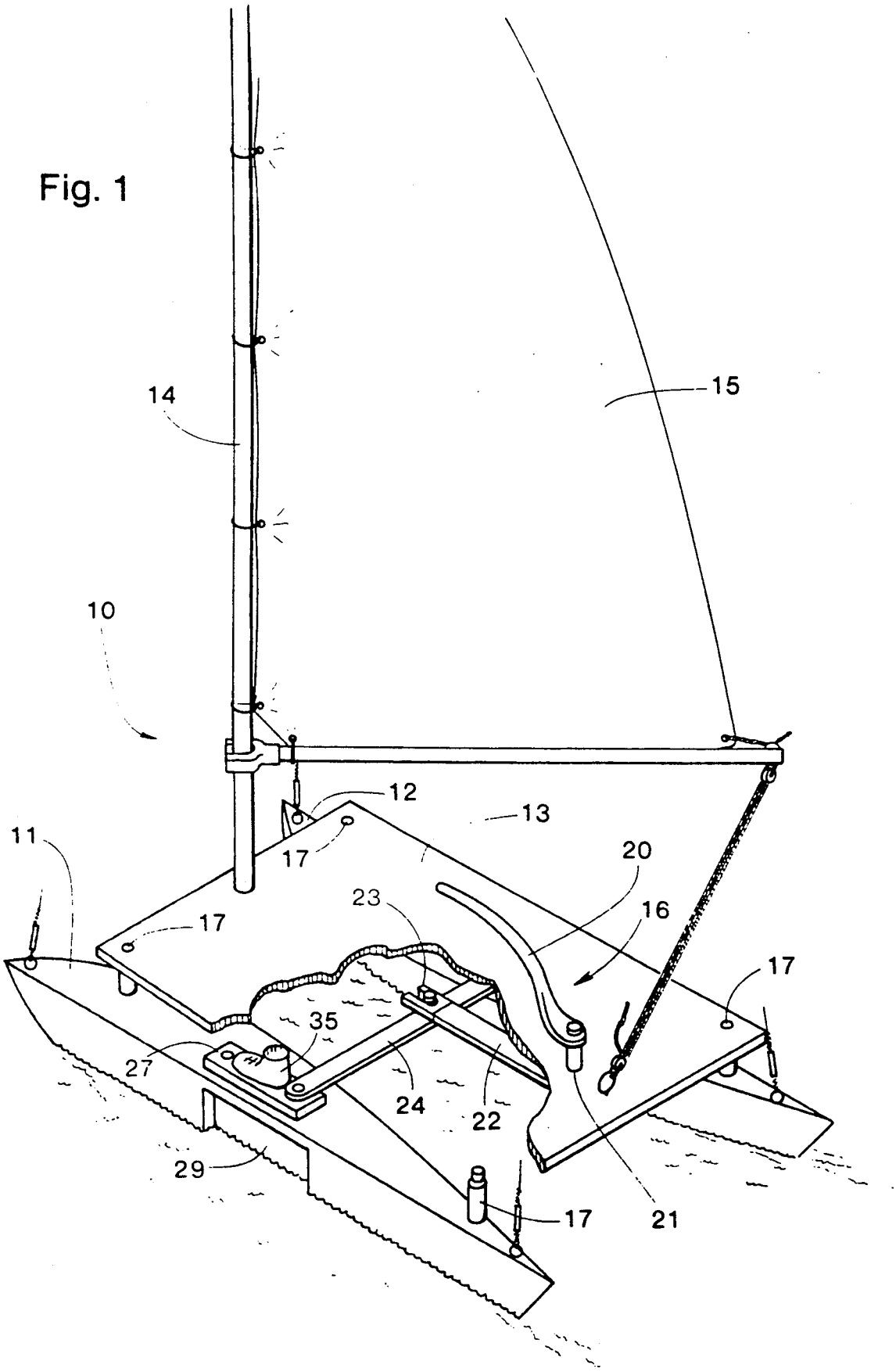
FIG. 1 is a perspective view of a catamaran sailboat according to this invention.
Figure 2:
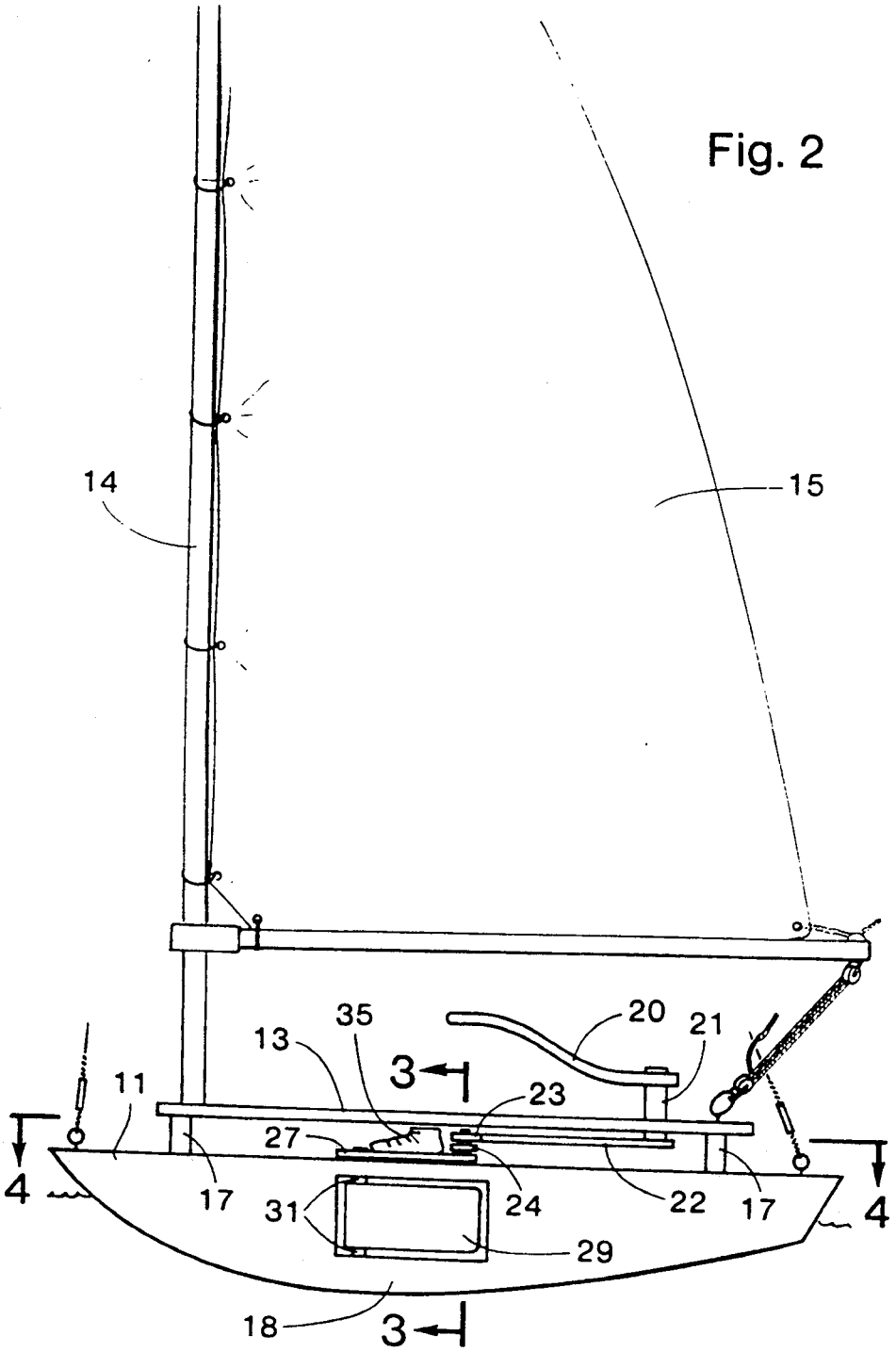
FIG. 2 is a side elevation view of the sailboat of FIG. 1.

Referring to FIG. 1, a catamaran sailboat 10 includes left and right hulls 11 and 12, a bridging deck 13 connecting the hulls 11 and 12, a mast and sail 14, 15, and a steering system 16. The deck 13 is mounted above the hulls 11 and 12 by struts 17. These major components are all separably connected so that the sailboat 10 is collapsible.

Reference is now to FIGS. 1, 2, 3, and 4. The steering system 16 includes a tiller 20 above the deck, and a tiller lever 22 below the deck, both fixed to a vertical shaft 21 which is mounted for rotation on the deck 13. The forward end of the tiller lever 22 is pivotally and slidably connected to the rear end of a yoke lever 23. The yoke lever 23 is mounted at its center for rotation on a fixed shaft 25 which depends from the deck 13. The forward end of the yoke lever 23 is pivotally and slidably connected to the center of a transverse rudder crossbar 24. The rudder crossbar 24 is in turn connected at its ends by pivotal connections 26 to the rear of a left rudder plate 27 on the left hull 11 and a right rudder plate 28 on the right hull 12.

A left rudder 29 is mounted in an opening in the left hull 11, below the left rudder plate 27. The left rudder 29 and the left rudder plate 27 are fixed to a left rudder shaft 31 for pivotal movement together relative to the left hull 11. A right rudder 30 is mounted in an opening in the right hull 12, below the right rudder plate 28. The right rudder 30 and the right rudder plate 28 are fixed to a right rudder shaft 32 for pivotal movement together relative to the right hull 12.

Movement of the tiller 20 to the right causes the rudder crossbar 24, and with it the trailing ends of rudder plates 27, 28 and rudders 29, 30 all to move left, steering the boat to the left as is conventional. Similarly, tiller movement to the left steers the boat to the right.

Figure 3:
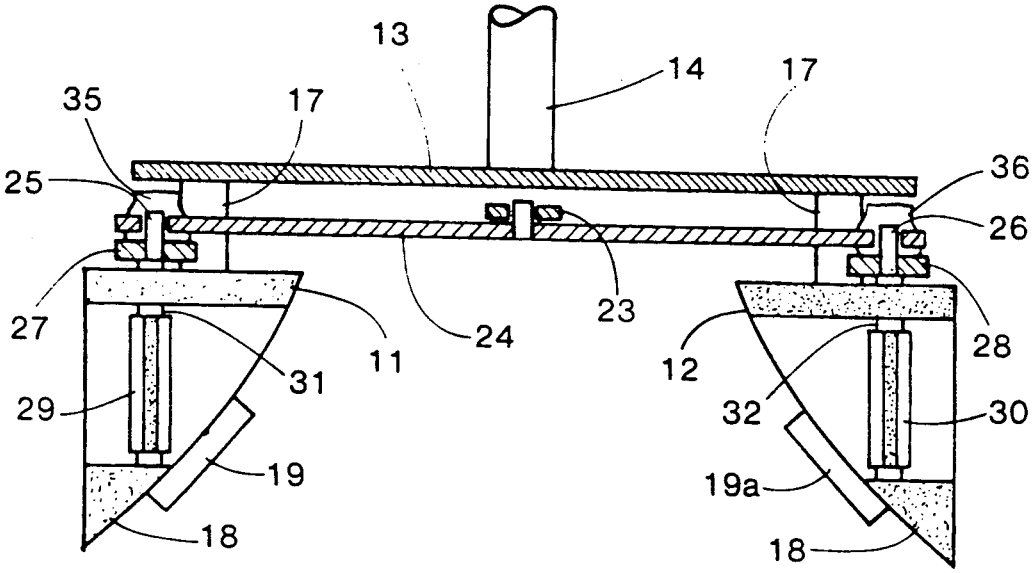
FIG. 3 is a rear elevation view of the sailboat of FIG. 1.
Figure 4:
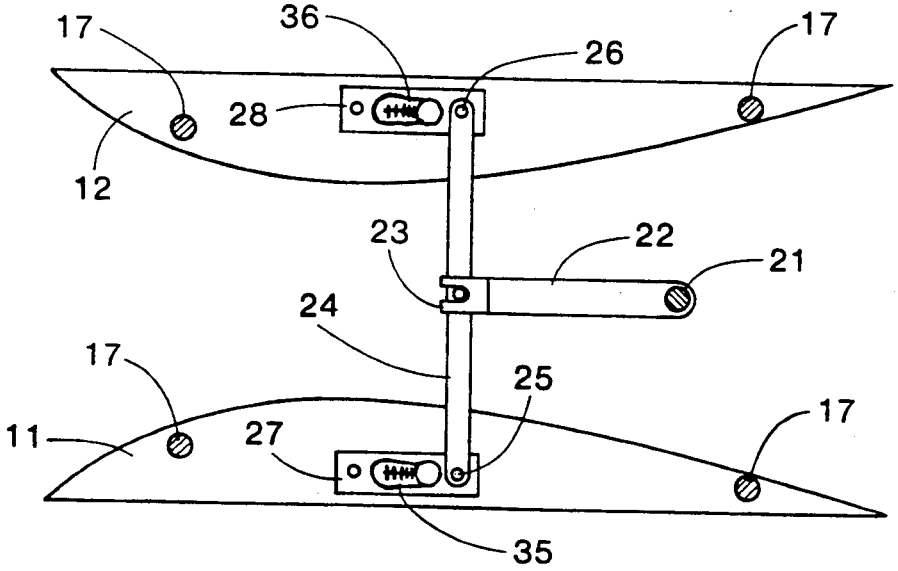
FIG. 4 is a detail view, taken along the line 4—4 of FIG. 2, of structure beneath the bridging deck.

As shown in FIG. 3, the individual hulls 11 and 12 are not symmetrical. Their keel portions 18 are off center. In the assembled boat, the keels are outboard of center to provide maximum effective width of the catamaran hulls for boat stability. Also, the rudders and rudder plates are located on the keel portions of the hulls, so the off-center keel permits the rudder plates to be located close to the edge of the hull.

A boot or footpiece 35 is fastened to the rudder plate 27 on the left hull 11 over the left rudder shaft 31. A similar boot 36 is fastened to the rudder plate 28 on the right hull 12 over the right rudder shaft 32.

FIG. 5 shows the hulls 11 and 12 in use as cross water skis. A skier is standing with feet in the boots 35 and 36. The left hull 11 is the right ski, and the right hull 12 is the left ski. With this transposition of skis, the rudder plates 27, 28 and boots 35, 36 are close together so that the skier's feet can be close together. This is the other purpose of the off-center keels: to enable the skier to stand in the skis with legs together in the normal way. (The hulls are relatively wide, and if the boots were centered, the skier would have to stand with legs spread to some extent)

The skier in FIG. 5 is holding two cross water ski poles 37. FIGS. 6 and 7 show one such pole 37, which includes a handle 38 and a pontoon 39. Because of the width of the hulls, the handle of each pole is offset at a mid portion thereof so that it extends outboard of the ski. This places the pontoon outboard of the ski without a special reaching effort by the skier. In using these skis, the skier poles himself along on water in generally the same way as he would on snow. The rudders 29 and 30 are operable by the skiers feet, acting through rudder plates 27, 28, and rudder shafts 31, 32 to turn the skis. The pontoon 39 is buoyant so that the pole provide support to the arms of the skier for poling and for upright stability of the skier.

The skis include one or more stationary fins 19 or (alternatively) movable flaps **19*a* to retard backward movement of the skis in the water. Fins 19 extend at an angle outward and backward. Flaps 19*a* lie on the ski surface during forward movement, and flap open to retard backward ski movement. FIG. 3 shows a representative fin 19 on one ski, and a flap 19*a* on the other. The flap 19*a*** is close to the ski (solid line) during forward motion, and extended (phantom line) to retard backward motion.

While a catamaran sailboat has been described, it is contemplated that the twin hulled boat might be a motorboat instead of a sailboat. That is, a motor can be attached to the rear of the deck 13 instead of a mast and sail.

The drawings are not to scale. Some relationships are exaggerated to facilitate illustration and description.

The foregoing description of a preferred embodiment of this invention is intended as illustrative. The concept and scope of the invention are limited only by the following claims and equivalents thereof.

What is claimed is:

1. A combination catamaran sailboat and cross water ski system including left and right hulls, a bridging deck, and a steering system;

each said hull including a keel portion, a rudder in said keel portion, and a rudder plate on the top of said hull, said rudder and said rudder plate operatively connected for horizontal pivotal movement on said hull, said rudder plate further including means for operative engagement with a foot of an operator;

said steering system including a tiller mounted for pivotal movement above said deck, a tiller lever system mounted for pivotal movement below said deck and operatively connected to said tiller, and a rudder crossbar operatively connected at its center to said tiller lever system and at its ends to said rudder plates;

said hulls being separable from said deck and said steering system and convertible to use as cross water skis.

2. A combination catamaran sailboat and cross water ski system including left and right hulls, a bridging deck, and a steering system;

each said hull including an off center keel portion, a rudder in said keel portion, and a rudder plate on the top of said hull, said rudder and said rudder plate operatively connected at their forward ends to a rudder shaft for horizontal pivotal movement on said hull, said rudder plate further including means for operative engagement with a foot of an operator;

said steering system including a tiller mounted for pivotal movement above said deck, a tiller lever system mounted for pivotal movement below said deck and operatively connected to said tiller, and a rudder crossbar operatively connected at its center to said tiller lever system and at its ends to said rudder plates;

said left and right hulls being separable from said deck and said steering system and convertible to use as right and left cross water skis respectively.

3. A combination catamaran sailboat and cross water ski system as defined in claim 2 in which said left hull further includes a footpiece connected to the rudder plate thereof to receive the right foot of a skier, and said right hull further includes a footpiece connected to the rudder plate thereof to receive the left foot of a skier.

4. A combination catamaran sailboat and cross water ski system as defined in claim 3 in which each said hull further includes a stationary fin to retard backward movement thereof in water.

5. A combination catamaran sailboat and cross water ski system as defined in claim 3 in which each said hull further includes a flap to retard backward movement thereof in water.

6. A combination catamaran sailboat and cross water ski system as defined in claim 2, further including a pair of ski poles, each said pole including a handle with an upper portion and a laterally offset lower portion, and a buoyant pontoon on the lower end thereof skier support.

* * * * *